US005532069A

United States Patent [19]

Masumoto et al.

[11] Patent Number: 5,532,069

[45] Date of Patent: Jul. 2, 1996

[54] ALUMINUM ALLOY AND METHOD OF PREPARING THE SAME

[75] Inventors: Tsuyoshi Masumoto, 8-22, Kamisugi 3-chome, Aoba-ku, Sendai-shi, Miyagi-ken; Akihisa Inoue, c/o Tohoku University Institute for Material Research, 1-1, Katahira 2-chome, Aoba-ku, Sendai-shi, Miyagi-ken; Toshihiko Kaji, Hyogo-ken; Junji Iihara, Hyogo-ken; Yoshishige Takano, Hyogo-ken, all of Japan

[73] Assignees: Tsuyoshi Masumoto; Akihisa Inoue, both of Sendai, Japan

[21] Appl. No.: 363,367

[22] Filed: Dec. 22, 1994

[30] Foreign Application Priority Data

Dec. 24, 1993 [JP] Japan ..... 5-328222

[51] Int. Cl.[6] ..... B22F 3/24

[52] U.S. Cl. ..... 428/552; 428/548; 428/567; 419/28; 419/30; 419/31; 419/38; 419/45

[58] Field of Search ..... 420/528, 550, 420/551; 419/28, 30, 31, 38, 45; 428/548, 567, 552

[56] References Cited

U.S. PATENT DOCUMENTS

| | | | |
|---|---|---|---|
| 4,379,719 | 4/1983 | Hildeman et al. | 419/60 |
| 5,284,532 | 2/1994 | Skinner | 148/549 |

FOREIGN PATENT DOCUMENTS

| | | | |
|---|---|---|---|
| 0303100 | 2/1989 | European Pat. Off. . | |
| 0333216 | 9/1989 | European Pat. Off. . | |
| 0475101 | 3/1992 | European Pat. Off. . | |
| 0570910 | 11/1993 | European Pat. Off. . | |
| 0570911 | 11/1993 | European Pat. Off. . | |
| 64-47831 | 2/1989 | Japan . | |
| 436404 | 5/1992 | Japan | B22F 1/100 |
| 4218638 | 12/1992 | Japan | C22C 21/00 |
| 5-279767 | 10/1993 | Japan . | |
| 5279767 | 2/1994 | Japan | C22C 1/04 |
| 5331584 | 3/1994 | Japan | C22C 21/00 |
| 6158211 | 9/1994 | Japan | C22C 21/02 |

OTHER PUBLICATIONS

Dictionary of Metallurgy by D. Birchon, George Newnes Limited pp. 110 and 111.

*Primary Examiner*—Donald P. Walsh
*Assistant Examiner*—John N. Greaves
*Attorney, Agent, or Firm*—W. G. Fasse; W. F. Fasse

[57] ABSTRACT

A dispersion-strengthened aluminum alloy having a composite structure containing a matrix of α-aluminum and a precipitation deposited phase of an intermetallic compound with the intermetallic compound in a volume ratio of not more than 35 vol. %, has both high strength and high toughness. The precipitation phase of the intermetallic compound has an aspect ratio of not more than 3.0, the α-aluminum has a crystal grain size which is at least twice the grain size of the precipitation phase of the intermetallic compound, and the crystal grain size of the α-aluminum is not more than 200 nm. It is possible to obtain an aluminum alloy having the aforementioned limited structure by carrying out first and second heat treatments on gas-atomized powder containing at least 10 vol. % of an amorphous phase or a green compact thereof and thereafter carrying out hot plastic working.

21 Claims, 3 Drawing Sheets

ALUMINUM ALLOY AND METHOD OF PREPARING THE SAME

BACKGROUND OF THE INVENTION

1. Field of the Invention

The present invention relates to a rapidly-solidified aluminum powder alloy having the so-called nanolevel fine structure with high strength and excellent toughness which is applicable to a part or a structural material requiring toughness, and relates to a method of preparing the same. More particularly, the invention relates to an aluminum alloy having a volume ratio of not more than 35 vol. % of an intermetallic compound that precipitated in a matrix, and to a method of preparing the same. The term "nanolevel structure" stands means a metallographic structure having a grain size not more than about several hundred nanometers (nm).

2. Description of the Background Art

Japanese Patent Laying-Open No. 64-47831 (1989) discloses an aluminum alloy having a nanolevel fine structure, which is obtained by heating rapidly-solidified aluminum alloy powder containing an amorphous phase and extruding the same.

Although the alloy obtained by the technique disclosed in this Laying-Open Publication No. 64-47831 has excellent strength (tensile strength and proof strength), its Charpy impact value is less than about ⅕ that of a conventional aluminum ingot material. Thus, it is difficult to employ this aluminum alloy as a material for a machine part or an automobile part which requires reliability.

On the other hand, the inventors have already proposed a method of employing rapidly-solidified aluminum alloy powder and heat treating its amorphous phase for powder-forging the same, in Japanese Patent Laying-Open No. 5-279767 (1993).

The technique proposed in the aforementioned Japanese Laying-Open No. 5-279767 is based on an idea of rapidly heating, then forging and thereafter rapidly cooling the powder for preventing the structure from developing coarseness and for attaining sufficient bonding strength between grains. However, this publication does not disclose any technique for forming a structure that is superior in strength and toughness by controlling the heating pattern in the heating step before forging.

SUMMARY OF THE INVENTION

Accordingly, an object of the present invention is to provide an aluminum alloy having higher strength and toughness as compared with the prior art and a method of preparing the same, for solving the aforementioned problem.

In order to solve that problem, the inventors have studied a structure of an aluminum alloy that is excellent in both strength and toughness. Consequently, the inventors have discovered that the volume ratio of an intermetallic compound that is dispersed in a matrix must indispensably i.e. critically be not more than 35 vol. %, in order to attain high toughness. The inventors have also discovered that good compatibility between strength and toughness is achieved by a composite structure which is formed by a matrix consisting of α-aluminum and a precipitation phase of an intermetallic compound having an aspect ratio of not more than 3.0, in which the crystal grain size of the α-aluminum is in a ratio of at least 2.0 relative to the grain size of the intermetallic compound and the absolute value of the α-aluminum crystal grain size is not more than 200 nm.

The inventors have further discovered that it is possible to obtain the aforementioned structure having both strength and toughness by carrying out first and second heat treatments on gas-atomized powder containing at least 10 vol. % of an amorphous phase or a green compact thereof and thereafter carrying out hot plastic working. It is particularly possible to readily carry out the aforementioned first and second heat treatments, i.e., step heating, by carrying out the hot plastic working by powder forging.

More particularly the inventors have discovered that it is possible to obtain the aforementioned structure while attaining sufficient bonding between grains by carrying out the first heat treatment at a first heating temperature between a low temperature that is 10K lower than the crystallization temperature (i.e., the precipitation temperature) of the α-aluminum or the intermetallic compound and a high temperature that is 100K higher than the crystallization temperature and then rapidly carrying out the second heat treatment by heating to a temperature that is at least 100K higher than the first heating temperature at a heating rate of at least 10K/sec.

The inventors have first investigated the reason why the conventional aluminum alloy having a nanolevel fine structure is inferior in toughness although it has high tensile strength. Consequently, it has been proved that the volume content of an intermetallic compound in the conventional aluminum alloy having a nanolevel structure generally is mostly about 40 vol. %.

Considering a material having a composite structure in which a hard dispersed phase exists in a soft matrix, its toughness begins to be reduced when the volume content of the hard dispersed phase reaches about 30 to 40%, regardless of the type of the material. This is because hard grains present in the matrix start being in contact or bonded with each other when the volume content thereof reaches about 30 to 40%, thus forming a hard and fragile framework in the material. In order to avoid this, it is necessary to set the volume content of the hard grains (intermetallic compound) in the material to be not more than 35%.

The conventional aluminum alloy having a nanolevel fine structure has a yield strength (or 0.2% proof stress) of 700 to 1000 MPa, and has a structure in which the volume content of the intermetallic compound is 40 vol. %, the grain size of the intermetallic compound is about 300 nm, and the crystal grain size of the α-aluminum is about 300 nm. Simply calculating the strength of such a structure, it is estimated that about half (about 450 MPa) of the yield strength of 700 to 1000 MPa is contributed by crystal grain refinement/strengthening (strengthening by the so-called Hall-Petch effect) and that the remaining half is contributed by composite dispersion strengthening (about 300 to 400 MPa) of the intermetallic compound and precipitation strengthening (about 50 MPa).

It is estimated that composite dispersion strengthening by the intermetallic compound is about 200 to 300 MPa in the inventive aluminum alloy, since the amount of the intermetallic compound is not more than 87% (=35/40) as compared with the aforementioned conventional aluminum alloy of a nanolevel structure. It is necessary to increase the rate of crystal grain refinement/strengthening, in order to compensate for such reduction in strength. In the aluminum alloy according to the present invention, therefore, the crystal grain size of the α-aluminum is limited to not more than 200 nm. It has been impossible to attain such a crystal grain size of α-aluminum by conventional extrusion, due to an increase in the heat history. According to strength calculations, it is possible to attain a strength of at least 540 MPa due to such fine crystal grains of α-aluminum.

The present invention does not aim to improve the strength of the aluminum alloy by composite dispersion strengthening of the intermetallic compound, but rather aims to improve both strength and toughness by crystal grain refinement/strengthening. If an attempt is made to improve the strength by composite dispersion strengthening of the intermetallic compound, then the ductility of the material is disadvantageously reduced. In the aluminum alloy according to the present invention, the intermetallic compound is simply directed to pinning between the grain boundaries. If the grains of the intermetallic compound are equivalent in size to the crystal grains of the α-aluminum, then the material is reduced in ductility. In the aluminum alloy according to the present invention, therefore, the grain size of the intermetallic compound is reduced to not more than half the crystal grain size of the α-aluminum. In other words, the ratio of the α-aluminum crystal grain size to the grain size of the intermetallic compound is limited to be at least 2.0.

The intermetallic compound that is precipitated in the aforementioned manner has sufficiently small grains. Therefore, stress concentration is suppressed in the interface between the intermetallic compound and the matrix, so that the aluminum alloy is hardly broken. If the aspect ratio of the intermetallic compound as precipitated is in excess of about 3.0, however, cracking starts from the precipitation phase of the intermetallic compound when external stress is applied to the aluminum alloy. A needle-like precipitate having an aspect ratio exceeding 3.0 is easy to break, and once the precipitate is broken, cracking starts from the broken portion. If the aspect ratio is not more than 3.0, on the other hand, the precipitation phase of the intermetallic compound is so difficult to break and is broken so little that no cracking starts from a broken portion.

The raw material powder employed in the present invention is prepared by gas atomization. However, it is difficult to attain a fine nanolevel structure at a low cooling rate in the powder preparation step, even if rapidly-solidified powder is employed. According to the present invention, powder containing at least 10 vol. % of an amorphous phase has a sufficiently fine structure in the remaining portion of not more than 90%. When such powder is employed as the raw material, therefore, it is possible to attain a structure limited in the aforementioned manner.

In general, the technical idea has not previously existed, of positively controlling a structure that is constructed through nucleation and nuclear growth of α-aluminum and an intermetallic compound in heating before a powder forging or powder extrusion step by controlling the heating pattern. It is possible to control the structure by step-heating the aforementioned gas-atomized powder or a green compact thereof in at least two stages for performing hot plastic working. Thus, it is possible to effectively attain a structure which is limited in the aforementioned manner.

Particularly important for controlling the structure is the first heat treatment in the step heat treatments. According to the present invention, the raw material is held at the first temperature between the low temperature that is 10K lower than the precipitation temperature, i.e., the crystallization temperature, of the α-aluminum and the high temperature that is 100K higher than the precipitation temperature, thereby finely precipitating the α-aluminum. If such a first heating temperature is less than the low temperature that is 10K lower than the precipitation temperature of the α-aluminum, the α-aluminum is not actively precipitated. If the first heating temperature exceeds the high temperature that is 100K higher than the precipitation temperature of the α-aluminum, on the other hand, the α-aluminum is disadvantageously coarsely precipitated.

Depending on the constitution of the aluminum alloy, the intermetallic compound and the α-aluminum may be simultaneously precipitated. In this case, the first heat treatment may be carried out at a temperature between the lower temperature that is 10K lower than the precipitation temperature of the intermetallic compound and the high temperature that is 100K higher than the precipitation temperature.

Further, third and fourth heat treatments may be properly carried out, in order to construct a structure which is limited in the aforementioned manner.

The second heat treatment of the step heating, i.e., the final stage heat treatment, is adapted to strongly bond the grains with each other. In order to carry out the second heat treatment at a sufficiently high temperature while preventing the structure from becoming coarse, the raw material is rapidly heated at a heating rate of at least 10K/sec. up to a second temperature that is at least 100K higher than the first heating temperature. The material is heated up to the second temperature that is at least 100K higher than the first heating temperature, in order that a sufficient powder softening temperature is ensured.

It is preferable that the first and second heat treatments are first and last heat treatments respectively.

In the method according to the present invention, the hot plastic working may be carried out by extrusion, while it is more preferable to employ powder forging. In powder extrusion, it is necessary to prepare an extruded material having the greatest possible length, to be capable of simultaneously providing a number of products in industrial operation, since forward and rear end portions (the so-called discards) of the extruded material are defective. Therefore, a preform body for extrusion forming is increased in size to include at least about 100 products. Thus, it is industrially difficult to uniformly heat the overall material in the extrusion step in the same heating pattern. By using powder forging, on the other hand, a preform body for forging has a size corresponding to one product, and hence it is possible to uniformly heat the overall material in the same heating pattern.

According to the present invention, as hereinabove described, it is possible to obtain an aluminum alloy that is superior to the prior art in both strength and toughness, such as tensile strength and elongation, for example.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS AND OF THE BEST MODE OF THE INVENTION

EXAMPLE 1

Aluminum alloy powder materials having the following two types of compositions were prepared by helium (He) gas atomization, and the powder materials as obtained were sieved to not more than 20 μm in grain size:

(A) $Al_{90.5}$—$Ni_{6.6}$—$La_{2.9}$ (the subscripts stand for atomic percentages, and the volume content of the intermetallic compound upon crystallization is 33 vol. %); and (B) $Al_{92.5}$—$Ce_{6.0}$—$Co_{1.5}$ (the subscripts stand for atomic percentages, and the volume content of the intermetallic compound upon crystallization is 32 vol. %).

As to the aforementioned two types of aluminum alloy powder materials (A) and (B), crystallization temperatures Tc and volume percentages of amorphous phases contained therein were examined by DSC and X-ray diffraction respectively.

The crystallization temperatures Tc were determined by examining heat generation upon crystallization by DSC (differential scanning calorimetry).

The volume percentage of the amorphous phase contained in each powder material was decided in the following method. First, an X-ray diffraction chart of perfect-crystalline aluminum was sampled, and then that of the powder containing the amorphous phase was also sampled. The volume percentage of the amorphous phase was determined by comparing the respective volumes of broad portions of peaks, which were broadly spread in the powder containing the amorphous phase, in the two X-ray diffraction charts.

Table 1 shows the crystallization temperatures and the amorphous phase contents of the materials having the compositions (A) and (B).

TABLE 1

| Composition | Crystallization Temperature (K) | Amorphous Phase Content |
|---|---|---|
| (A) | 558 | 30 |
| (B) | 550 | 12 |

The aluminum alloy powder materials having the two types of compositions (A) and (B) prepared in the aforementioned manner were cold-embossed by a rectangular metal mold having a section of 9.5 mm by 29 mm with a bearing pressure of 390 MPa. Each of the embossed bodies as obtained weighed 10 g.

Figure 1:
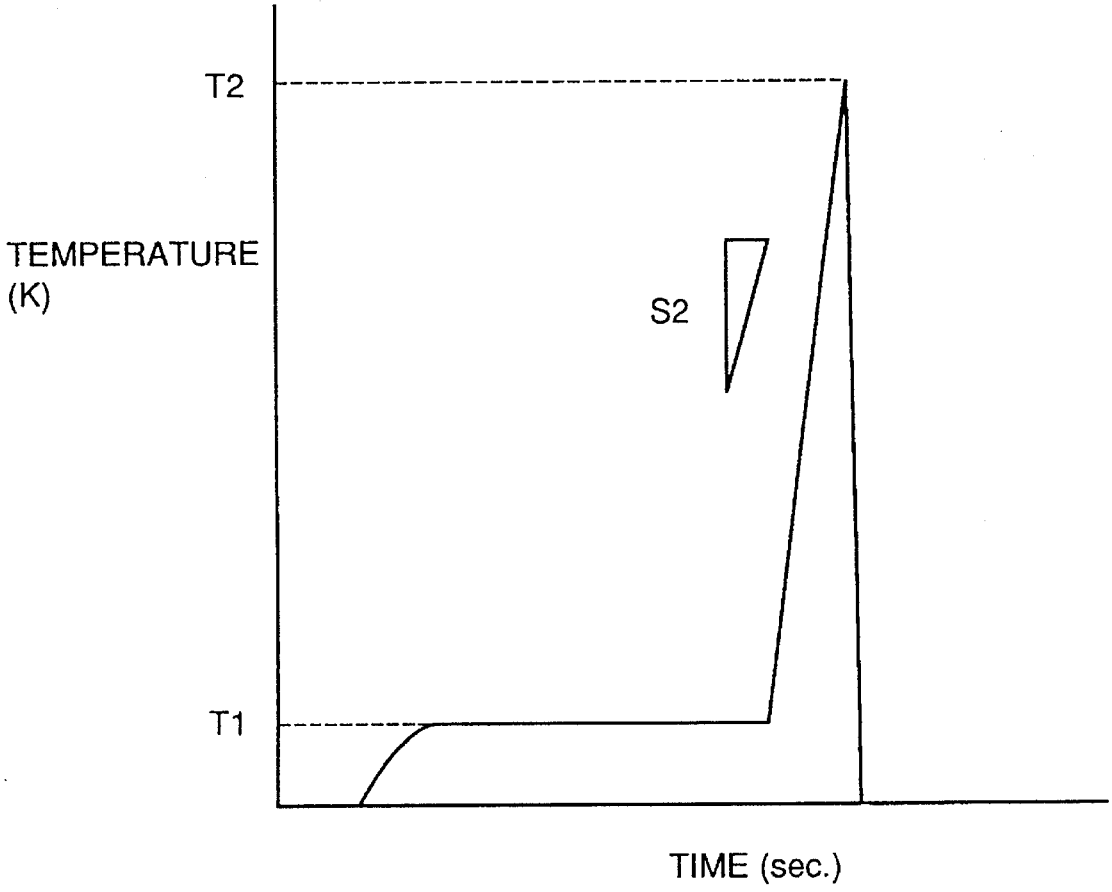
FIG. 1 is a graph showing the relation between temperature and time defining a two stage heat treatment carried out in an example of the present invention.

These embossed bodies were subjected to two-stage rapid heat treatments as shown in FIG. 1. Referring to FIG. 1, T1, S2 and T2 respectively represent the first stage heating temperature, the second stage heating rate and the second stage heating temperature.

The embossed bodies that were heat treated in the aforementioned manner were inserted in a metal mold (temperature: 773° K.) having a section of 10 mm by 30 mm, and forged with a bearing pressure of 780 MPa. Thereafter the forged bodies were cooled with water.

Figure 2:
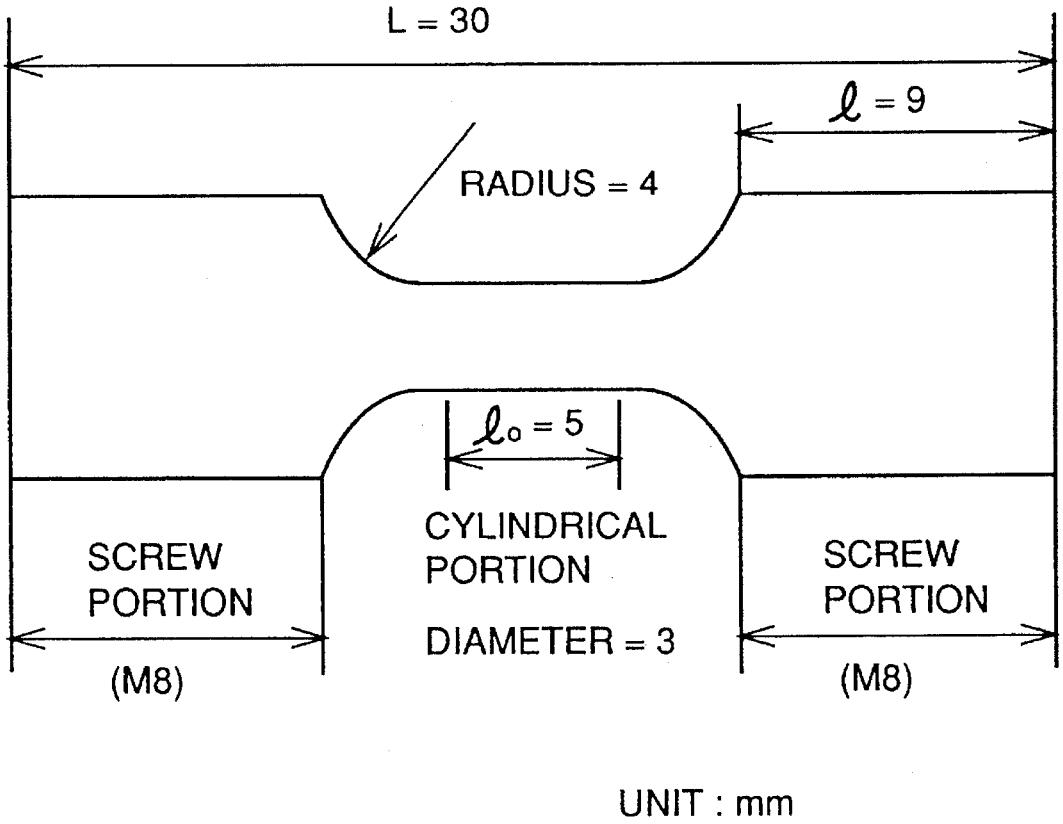
FIG. 2 illustrates the shape of a tensile test piece prepared in the example of the invention.

A tensile test piece having a shape shown in FIG. 2 was prepared from each of the forged bodies Namely, the tensile test piece had a total length of 30 mm, including a central cylindrical portion with a diameter of 3 mm and a length of 5 mm and including two end screw portions with a length of 9 mm. Shoulders with a 4 mm radius of curvature form a transition from the cylindrical portion to the end portions. This tensile test piece was subjected to a tensile test at room temperature.

After the tensile test, an undistorted portion of a fracture surface of each test piece was polished and subjected to structural observation with a scanning electron microscope (SEM).

For the purpose of comparison, comparative samples were subjected to only the second heat treatment with omission of the first treatment, and forged. The obtained forged bodies were subjected to a tensile test at room temperature, and then the fracture surfaces after the test were observed with a scanning electron microscope.

Table 2 shows results of measurement of characteristics of the respective samples having the compositions (A) and (B).

Referring to Table 2, "UTS" stands for tensile strength, "α/IMC" stands for ratios of α-aluminum crystal grain sizes to grain sizes of intermetallic compounds, "α Size" stands for α-aluminum crystal grain sizes, and "Aspect Ratio" stands for aspect ratios of the intermetallic compounds. As to "Evaluation", the samples marked with o satisfied either UTS≧800 MPa and elongation ≧1%, or UTS ≧750 MPa and elongation ≧2% while the samples marked with x did not satisfy either of those conditions. As to "Fracture Surface", the samples marked with o exhibited excellent structures, while the sample marked with x exhibited a defective structure.

TABLE 2

| No. | Composition | T1 (K) | S2 (K/s) | T2 (K) | UTS (MPa) | Elongation | Fracture Surface | Aspect Ratio | α/IMC | α Size (nm) | Evaluation | |
|---|---|---|---|---|---|---|---|---|---|---|---|---|
| 1 | (A) TC = 558K | TC-15 | 20 | 873 | 789 | 0.6 | O | 4–10 | 3.0 | 70 | X | Comparative Sample |
| 2 | | TC | 15 | 823 | 874 | 2.4 | O | 2–3 | 3.0 | 60 | O | Inventive Sample |
| 3 | | TC + 10 | 15 | 863 | 799 | 3.8 | O | 1–2.5 | 3.5 | 70 | O | Inventive Sample |
| 4 | (B) TC = 550K | TC-5 | 20 | 863 | 801 | 2.8 | O | 1–2 | 3.0 | 70 | O | Inventive Sample |
| 5 | | TC | 15 | 873 | 781 | 3.0 | O | 1.5–2.5 | 3.5 | 170 | O | Inventive Sample |
| 6 | | TC | 5 | 873 | 647 | 2.7 | O | 1–1.5 | 3.0 | 400 | X | Comparative Sample |
| 7 | | TC | 15 | 750 (Tc + 200) | 864 | 1.5 | O | 1–1.5 | 2.0 | 50 | O | Inventive Sample |
| 8 | | TC | 15 | 620 (Tc + 70) | 568 | 0.0 | X | 1–2 | 1.5 | 40 | X | Comparative Sample |

TABLE 2-continued

| No. | Composition | T1 (K) | S2 (K/s) | T2 (K) | UTS (MPa) | Elongation | Fracture Surface | Aspect Ratio | α/IMC | α Size (nm) | Evaluation | |
|---|---|---|---|---|---|---|---|---|---|---|---|---|
| 9 | | Tc + 10 | 15 | 823 | 821 | 2.1 | ○ | 1.5–2 | 2.5 | 50 | ○ | Inventive Sample |
| 10 | | Tc + 50 | 15 | 873 | 774 | 3.5 | ○ | 1–2 | 3.0 | 180 | ○ | Inventive Sample |
| 11 | | Tc + 200 | 15 | 903 | 683 | 1.9 | ○ | 1–2 | 1.5 | 300 | X | Comparative Sample |
| 12 | | No | 15 | 873 | 745 | 1.3 | ○ | 5–8 | 2.5 | 150 | X | Comparative Sample |

It is clearly understood from Table 2 that the inventive samples satisfy the aforementioned conditions in both tensile strength (UTS) and elongation.

As to the sample No. 8, the grains were inferiorly joined with each other due to the low second stage temperature T2, and it was recognized through observation of the fracture surface with the scanning electron microscope that the fracture surface was broken along old powder boundaries.

Figure 3:
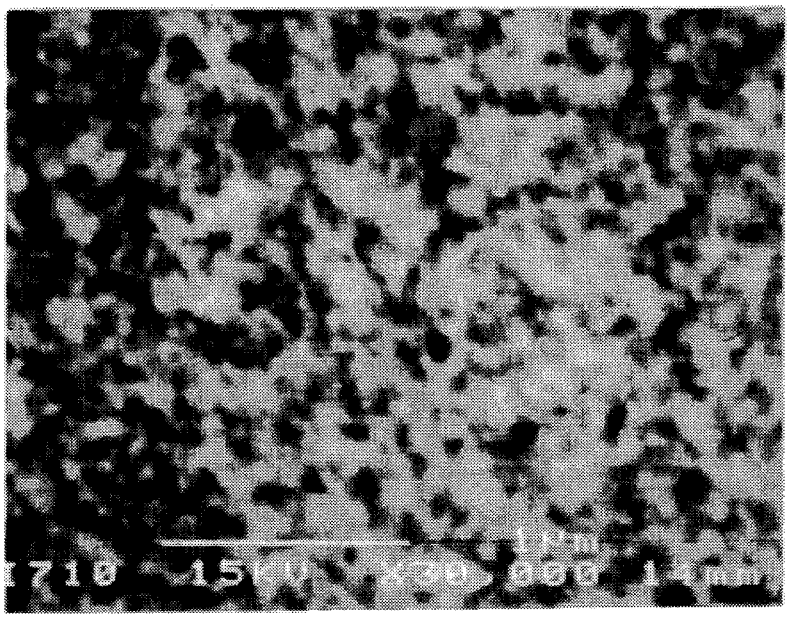
FIG. 3 is a photograph showing an excellent metallographic structure of a tensile test piece employed in the example of the invention.
Figure 4:
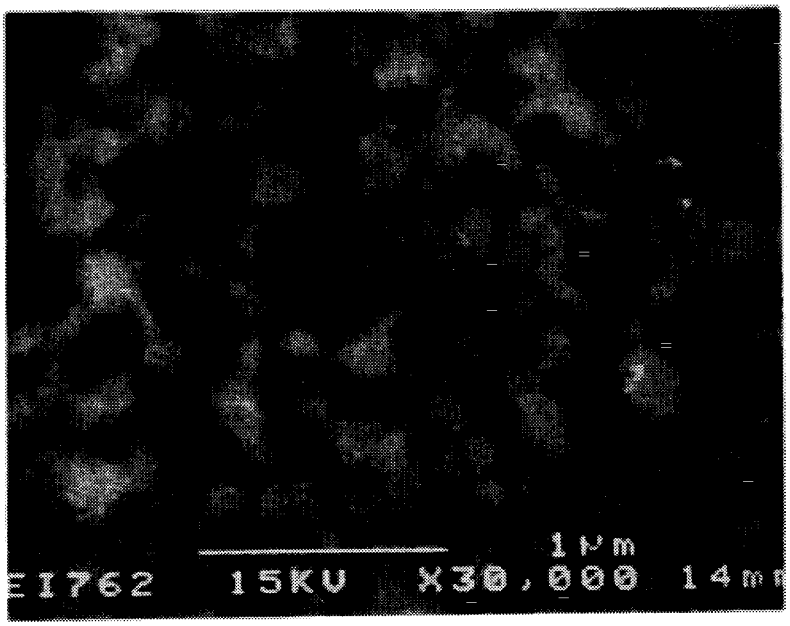
FIG. 4 is a photograph showing a defective metallographic structure of a tensile test piece employed in the example.

FIG. 3 is a photograph showing an example of an excellent structure, and FIG. 4 is a photograph showing an example of a defective structure.

EXAMPLE 2

Aluminum alloy powder materials having compositions (at. %) shown in Table 3 were prepared similarly to Example 1. Referring to Table 3, "am.Vf" stands for volume percentages of amorphous phases contained in the respective powder materials. The volume percentages of the amorphous phases were determined similarly to Example 1. Further referring to Table 3, "IMC Vf" stands for volume contents of intermetallic compounds upon crystallization.

Crystallization temperatures Tc shown in Table 4 were also determined similarly to Example 1.

Embossed bodies were prepared from the respective aluminum alloy powder materials that were prepared in the aforementioned manner similarly to Example 1, and thereafter two-stage rapid heat treatments as shown in FIG. 1 were carried out on the embossed bodies.

The embossed bodies that were heat treated in the aforementioned manner were forged similarly to Example 1. A tensile test piece having the configuration shown in FIG. 2 was prepared from each of the obtained forged bodies and was then subjected to a tensile test and structural observation similarly to Example 1.

Table 4 shows the results, similarly to Table 2.

TABLE 3

| No. | Al | Fe | Ni | Mn | Co | La | Ce | Y | Nd | am.Vf | IMCVf |
|---|---|---|---|---|---|---|---|---|---|---|---|
| 13 | 92.5 | 6 | | | | 1.5 | | | | 16% | 32% |
| 14 | 92.5 | 6 | | | | 1.5 | | | | | |
| 15 | 92.5 | 6 | | | | | 1.5 | | | 15% | 32% |
| 16 | 92.5 | 6 | | | | | 1.5 | | | | |
| 17 | 92.5 | 6 | | | | | | 1.5 | | 15% | 31% |
| 18 | 92.5 | 6 | | | | | | 1.5 | | | |
| 19 | 92.5 | 6 | | | | | | | 1.5 | 16% | 32% |
| 20 | 92.5 | 6 | | | | | | | 1.5 | | |
| 21 | 92.5 | | 6 | | | 1.5 | | | | 24% | 30% |
| 22 | 92.5 | | 6 | | | 1.5 | | | | | |
| 23 | 92 | | 6.5 | | | | 1.5 | | | 25% | 32% |
| 24 | 92 | | 6.5 | | | | 1.5 | | | | |
| 25 | 92.5 | | 6.5 | | | | | 1 | | 23% | 28% |
| 26 | 92.5 | | 6.5 | | | | | 1 | | | |
| 27 | 92.5 | | 6.5 | | | | | | 1 | 23% | 29% |
| 28 | 92.5 | | 6.5 | | | | | | 1 | | |
| 29 | 94.5 | | | 1 | | 4.5 | | | | 25% | 32% |
| 30 | 94.5 | | | 1 | | 4.5 | | | | | |
| 31 | 94 | | | 1 | | | 5 | | | 25% | 34% |
| 32 | 94 | | | 1 | | | 5 | | | | |
| 33 | 94 | | | 1 | | | | 5 | | 26% | 30% |
| 34 | 94 | | | 1 | | | | 5 | | | |
| 35 | 94 | | | 1 | | | | | 5 | 27% | 30% |
| 36 | 94 | | | 1 | | | | | 5 | | |
| 37 | 94.5 | | | | 4 | 1.5 | | | | 15% | 29% |
| 38 | 94.5 | | | | 4 | 1.5 | | | | | |
| 39 | 94 | | | | 3 | | 3 | | | 19% | 32% |
| 40 | 94 | | | | 3 | | 3 | | | | |
| 41 | 94 | | | | 2 | | | 4 | | 24% | 29% |
| 42 | 94 | | | | 2 | | | 4 | | | |
| 43 | 93.5 | | | | 2 | | | | 4.5 | 26% | 31% |
| 44 | 93.5 | | | | 2 | | | | 4.5 | | |

TABLE 4

| No. | Tc (K) | T1 (K) | S2 (K/s) | T2 (K) | UTS (MPa) | Elongation (%) | Fracture Surface | Aspect Ratio | α/IMC | α Size (nm) | Evaluation |
|---|---|---|---|---|---|---|---|---|---|---|---|
| 13 | 565 | 565 | 20 | 853 | 754 | 2.0 | ○ | 1.0–2.0 | 2.3 | 96 | ○ |
| 14 | | 565 | 5 | 853 | 695 | 6.3 | ○ | 2.0–2.5 | 2.5 | 230 | X |
| 15 | 559 | 559 | 20 | 853 | 770 | 3.2 | ○ | 1.0–2.0 | 2.5 | 93 | ○ |
| 16 | | 559 | 15 | 853 | 755 | 4.0 | ○ | 1.0–2.0 | 2.4 | 120 | ○ |
| 17 | 589 | 589 | 20 | 853 | 768 | 4.1 | ○ | 1.0–2.0 | 2.8 | 97 | ○ |
| 18 | | 639 | 20 | 853 | 760 | 6.0 | ○ | 2.0–2.5 | 2.6 | 135 | ○ |
| 19 | 576 | 576 | 20 | 853 | 756 | 3.0 | ○ | 1.0–2.0 | 2.3 | 97 | ○ |
| 20 | | 776 | 20 | 853 | 760 | 1.5 | ○ | 1.5–2.0 | 1.5 | 150 | X |
| 21 | 558 | 558 | 20 | 853 | 776 | 6.6 | ○ | 1.0–2.0 | 2.5 | 122 | ○ |

TABLE 4-continued

| No. | Tc (K) | T1 (K) | S2 (K/s) | T2 (K) | UTS (MPa) | Elongation (%) | Fracture Surface | Aspect Ratio | α/IMC | α Size (nm) | Evaluation |
|---|---|---|---|---|---|---|---|---|---|---|---|
| 22 | | 558 | 20 | 650 | 590 | 0.2 | X | 1.0–1.5 | 2.0 | 70 | X |
| 23 | 551 | 551 | 20 | 853 | 779 | 5.4 | O | 1.0–2.0 | 2.8 | 123 | O |
| 24 | | 551 | 20 | 880 | 765 | 6.0 | O | 1.5–2.5 | 2.2 | 175 | O |
| 25 | 583 | 583 | 20 | 853 | 775 | 9.2 | O | 2.0–2.5 | 2.7 | 119 | O |
| 26 | | 578 | 20 | 853 | 795 | 8.9 | O | 1.5–2.0 | 2.8 | 110 | O |
| 27 | 570 | 570 | 20 | 853 | 772 | 9.9 | O | 2.0–2.5 | 2.3 | 110 | O |
| 28 | | 570 | 5 | 853 | 740 | 11.5 | O | 2.0–2.5 | 1.8 | 210 | X |
| 29 | 554 | 554 | 20 | 853 | 779 | 6.0 | O | 2.0–2.5 | 2.5 | 123 | O |
| 30 | | 554 | 15 | 853 | 770 | 5.0 | O | 2.0–2.5 | 2.5 | 151 | O |
| 31 | 548 | 548 | 20 | 853 | 782 | 6.4 | O | 1.5–2.5 | 2.8 | 123 | O |
| 32 | | 853 | 20 | 853 | 703 | 8.3 | O | 3.0–3.5 | 2.5 | 195 | X |
| 33 | 576 | 576 | 20 | 853 | 807 | 2.1 | O | 1.0–1.5 | 2.7 | 101 | O |
| 34 | | 576 | 15 | 853 | 780 | 2.5 | O | 1.0–1.5 | 2.7 | 135 | O |
| 35 | 564 | 564 | 20 | 853 | 786 | 8.8 | O | 2.0–2.5 | 2.5 | 131 | O |
| 36 | | 564 | 5 | 853 | 680 | 6.5 | O | 2.0–2.5 | 2.3 | 210 | X |
| 37 | 560 | 560 | 20 | 853 | 786 | 2.7 | O | 1.0–2.0 | 2.7 | 94 | O |
| 38 | | 560 | 20 | 800 | 790 | 2.5 | O | 1.0–2.0 | 2.7 | 85 | O |
| 39 | 550 | 550 | 20 | 853 | 762 | 2.7 | O | 1.5–2.5 | 2.2 | 107 | O |
| 40 | | 750 | 20 | 853 | 680 | 1.8 | O | 2.5–3.0 | 1.5 | 193 | X |
| 41 | 586 | 586 | 20 | 853 | 779 | 9.9 | O | 2.0–2.5 | 2.8 | 122 | O |
| 42 | | 600 | 20 | 853 | 780 | 10.0 | O | 2.0–2.5 | 3.0 | 130 | O |
| 43 | 570 | 570 | 20 | 853 | 803 | 1.2 | O | 2.0–2.5 | 2.0 | 98 | O |
| 44 | | 570 | 20 | 650 | 780 | 0.1 | X | 1.0–1.5 | 2.0 | 53 | X |

Although the present invention has been described and illustrated in detail, it is clearly understood that the above description is by way of illustration and example only and is not to be taken by way of limitation, the spirit and scope of the present invention being limited only by the terms of the appended claims.

What is claimed is:

1. A method of preparing a dispersion-strengthened aluminum alloy having a composite structure containing a matrix of α-aluminum and not more than 35 vol. % of a precipitation phase of an intermetallic compound, said method comprising:

(a) preparing a sample to be treated, of gas-atomized powder containing at least 10 vol. % of an amorphous phase;

(b) heat treating said sample at an elevated first temperature above room temperature;

(c) heat treating said sample at a second temperature greater than said first temperature; and (d) performing hot plastic working on said sample.

2. The method of claim 1, wherein said step (a) comprises maintaining said gas-atomized powder in powder form to prepare said sample.

3. The method of claim 1, wherein said step (a) comprises forming a green compact of said gas-atomized powder to prepare said sample.

4. The method of claim 1, wherein said step (a) comprises limiting said powder to a grain size not more than 20 μm.

5. The method of claim 1, wherein said hot plastic working comprises powder forging.

6. The method of claim 1, wherein said step (b) comprises holding said sample at said first temperature for finely precipitating at least one of said α-aluminum and said intermetallic compound, said step (c) comprises holding said sample at said second temperature for achieving strong grain bonding, and said hot plastic working is carried out at said second temperature.

7. The method of claim 1, further comprising a step of heating-up said sample to said first temperature between said steps (a) and (b), and a step of heating-up said sample from said first temperature to said second temperature at a heating rate of at least 10K/sec.

8. The method of claim 1, wherein said first temperature is in the range from 10K lower to 100K higher than a crystallization temperature of said α-aluminum, and said second temperature is at least 100K higher than said first temperature.

9. The method of claim 8, further comprising heating-up said sample at a heating rate of at least 10K/sec between said steps (b) and (c).

10. The method of claim 8, wherein said step (b) comprises holding said sample at said fist temperature for finely precipitating said α-aluminum.

11. The method of claim 1, wherein said first temperature is in the range from 10K lower to 100K higher than a crystallization temperature of said intermetallic compound, and said second temperature is at least 100K higher than said first temperature.

12. The method of claim 11, further comprising heating-up said sample at a heating rate of at least 10K/sec between said steps (b) and (c).

13. The method of claim 11, wherein said step (b) comprises holding said sample at said first temperature for finely precipitating said intermetallic compound.

14. The method of claim 1, wherein said first temperature is in the range from about a crystallization temperature of said sample to about 50K higher than said crystallization temperature, said second temperature is at least about 200K higher than said first temperature, said step (b) comprises maintaining said first temperature for a hold time, and said step (d) is performed at said second temperature.

15. The method of claim 14, further comprising a step of heating-up said sample from said first temperature to said second temperature at a heating rate of at least 10K/sec.

16. The method of claim 1, wherein said steps (b), (c), and (d) are carried out in direct immediate succession and the method includes no temperature-holding heat treatments beyond said steps (b) and (c).

17. A dispersion strengthened aluminum alloy prepared by the method of claim 1 and having a composite structure containing a matrix of α-aluminum and not more than 35 vol. % of a precipitation phase of an intermetallic compound, wherein said α-aluminum has a crystal grain size not more than 200 nm, and wherein said precipitation phase has an aspect ratio of not more than 3.0 and a crystal grain size not more than half of said crystal grain size of said α-aluminum.

18. A dispersion-strengthened aluminum alloy having a composite structure containing a matrix of α-aluminum and not more than 35 vol. % of a precipitation phase of an intermetallic compound, wherein said α-aluminum has a crystal grain size not more than 200 nm, and wherein said precipitation phase has an aspect ratio of not more than 3.0 and a crystal grain size not more than half of said crystal grain size of said α-aluminum.

19. The aluminum alloy of claim 18, having a tensile strength of at least 800 MPa and an elongation of at least 1%, or having a tensile strength of at least 750 MPa and an elongation of at least 2%.

20. The aluminum alloy of claim 18, containing not more than 33 vol. % of said precipitation phase, and wherein said aspect ratio of said precipitation phase is not more than 2.5, said α-aluminum crystal grain size is not more than about 150 nm, and said precipitation phase crystal grain size is not more than about 0.44 times said α-aluminum crystal grain size.

21. The aluminum alloy of claim 18, prepared by heat treating and hot plastic working an air atomized powder starting material essentially consisting of from about 90.5 at. % to about 94.5 at. % of Al, from about 1 at. % to about 6.6 at. % of at least one element selected from Fe, Ni, Mn, and Co, and from about 1 at. % to about 6 at. % of at least one element selected from La, Ce, Y, and Nd.

* * * * *